US006206721B1

(12) United States Patent
Ishida

(10) Patent No.: US 6,206,721 B1
(45) Date of Patent: Mar. 27, 2001

(54) PRESSURE CONTACT TERMINAL HAVING MULTIPLE WIDTH WIRE CUTTING EDGES

(75) Inventor: Junko Ishida, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/272,177

(22) Filed: Mar. 18, 1999

(30) Foreign Application Priority Data

Mar. 20, 1998 (JP) ..... 10-072581

(51) Int. Cl.[7] ..... H01R 4/24; H01R 4/26; H01R 11/20

(52) U.S. Cl. ..... 439/397

(58) Field of Search ..... 439/397, 398, 439/387, 389, 391, 395, 157

(56) References Cited

U.S. PATENT DOCUMENTS

| | | | | |
|---|---|---|---|---|
| 4,291,935 | * | 9/1981 | Badoz et al. | 439/399 |
| 4,346,955 | * | 8/1982 | Chesnais et al. | 439/407 |
| 4,648,673 | * | 3/1987 | Endo et al. | 439/395 |
| 5,588,868 | * | 12/1996 | Tsuji et al. | 439/397 |
| 5,879,182 | * | 3/1999 | Abe | 439/397 |
| 5,913,695 | * | 6/1999 | Okabe | 439/397 |
| 5,928,025 | * | 7/1999 | Abe | 439/397 |
| 5,980,300 | * | 11/1999 | Okabe | 439/397 |
| 6,033,255 | * | 3/2000 | Murofushi | 439/397 |
| 6,077,103 | * | 6/2000 | Saka et al. | 439/397 |

FOREIGN PATENT DOCUMENTS 63-23626 5/1988 (JP) ..... H01R/4/24

* cited by examiner

*Primary Examiner*—Khiem Nguyen
*Assistant Examiner*—Michael C. Zarroli
(74) *Attorney, Agent, or Firm*—Finnegan, Henderson, Farabow, Garrett & Dunner, L.L.P.

(57) ABSTRACT

A pressure contact terminal includes a bottom plate, a pair of side plates rising from both sides of the bottom plate in same direction and a plurality of pressure contact cutting edges. The pressure contact cutting edges are formed in a manner such that a pair of pressure contact plates are projected from the pair of the side plates so as to face each other. The pressure contact cutting edges formed with a plurality of pressure contact slots into which a covered electric wire is press-fitted. The plurality of pressure contact cutting edges contains at least two wide pressure contact cutting edges having the pressure contact slots with wide width and a narrow pressure contact cutting edge having the pressure contact slot with narrower width than that of the pressure contact slots of the wide pressure contact cutting edges. The narrow pressure contact cutting edge is arranged between the wide pressure contact cutting edges in an axial direction of the covered electric wire.

2 Claims, 3 Drawing Sheets

PRESSURE CONTACT TERMINAL HAVING MULTIPLE WIDTH WIRE CUTTING EDGES

BACKGROUND OF THE INVENTION

1. Field of the Invention

The present invention relates to a pressure contact terminal having pressure contact cutting edges which are formed so that a pair of pressure contact plates are projected from a pair of side plates with them facing each other.

2. Description of the Related Art

FIG. 1 shows a pressure contact terminal 1 disclosed in Japanese Patent Application Publication, Specification No. 63-23626 (1988). In this drawing, the pressure contact terminal 1 is composed of a contact section 2, a pressure contact section 3 and an electric wire holding section 4 which are formed by successively bending sheet metallic material with uniform thickness. Four pressure contact cutting edges 5, 6, 7 and 8 are formed on the pressure contact section 3 along an axial direction of a covered electric wire. These pressure contact cutting edges 5, 6, 7 and 8 are constituted so that both sides of insertion slots 9 into which the covered electric wire is inserted are cutting edge sections 10, and when the covered electric wire is press-fitted into the insertion slots 9, the covered electric wire is cut by the cutting edge sections 10. When a core wire section is connected with the cutting edge sections 10, the pressure contact terminal 1 is electrically connected with the covered electric wire.

In this pressure contact terminal 1, the insertion slots 9 of the four pressure contact cutting edges 5, 6, 7 and 8 are set so as to have different widths, namely, the pressure contact cutting edge 5 is used only for a thin electric wire, the pressure contact cutting edge 6 is used only for a thick electric wire, and the pressure contact cutting edges 7 and 8 are commonly used for thin and thick electric wires. As a result, electric wires having different sizes can be press-fitted commonly into one pressure contact terminal.

Incidentally, in the case where the widths of the insertion slots 9 of the pressure contact cutting edges are set like the above pressure contact terminal 1, for example, when the combination of the pressure contact cutting edge 5 having the insertion slot 9 with narrow width and the two pressure contact cutting edges 6 and 7 having the insertion slots 9 with width wider than that of the insertion slot 9 of the pressure contact cutting edge 5 are is used for electric wires with different sizes, the three pressure contact cutting edges 5, 6 and 7 cut into the covered portion of the thin electric wire satisfactorily. As a result, satisfactory contact can be obtained, and further a holding force of the electric wire in the axial direction can be obtained sufficiently.

However, when a thick electric wire is press-fitted into the insertion slot 9 of the pressure contact cutting edges 5, 6 and 7, the pressure contact cutting edge 5 having the narrow insertion slot 9 whittles the core wire portion of the thick electric wire, and satisfactory contact is obtained only for the two pressure contact cutting edges 6 and 7 having the wide insertion slots 9. For this reason, since the thick electric wire is press-fitted into and held at the two pressure contact cutting edges 6 and 7, the holding force in the axial direction becomes weaker, and the sufficient holding force cannot be obtained.

SUMMARY OF THE INVENTION

The present invention has been achieved with such points in mind.

It therefore is an object of the present invention to provide a pressure contact terminal which is capable of preventing a core wire portion of a thick electric wire from being whittled, obtaining satisfactory contact at all pressure contact cutting edges, and bringing electric wires with different sizes into press-contact therewith commonly.

In order to achieve the above object, according to a first aspect of the present invention, there is provided a pressure contact terminal, comprising: a bottom plate; a pair of side plates rising from both sides of the bottom plate in same direction; and a plurality of pressure contact cutting edges, the pressure contact cutting edges formed in a manner such that a pair of pressure contact plates are projected from the pair of the side plates so as to face each other, the pressure contact cutting edges formed with a plurality of pressure contact slots into which a covered electric wire is press-fitted so that the covered electric wire is press-fitted between the pressure contact plates; wherein the plurality of pressure contact cutting edges contains at least two wide pressure contact cutting edges having the pressure contact slots with wide width and a narrow pressure contact cutting edge having the pressure contact slot with narrower width than that of the pressure contact slots of the wide pressure contact cutting edges; wherein the wide pressure contact cutting edges are arranged along an axial direction of the covered electric wire; and wherein the narrow pressure contact cutting edge is arranged between the wide pressure contact cutting edges.

In this pressure contact terminal, when a thick electric wire is press-fitted into the plural pressure contact cutting edges, the satisfactory contact with the core wire portion of the thick electric wire can be obtained at the wide pressure contact cutting edges. Moreover, since the pair of the side plates spread outward, even in the case of the thick electric wire, its core wire portion is not whittled by the narrow pressure contact cutting edges, and thus the satisfactory contact can be obtained. Therefore, even in the case of the thick electric wire, the satisfactory contact can be obtained at the plural pressure contact cutting edges, and the holding force does not weaken.

According to second aspect of the present invention, there is provided the pressure contact terminal which is constituted so that at least two narrow pressure contact cutting edges are arranged between the wide pressure contact cutting edges.

In this pressure contact terminal, when a thick electric wire is press-fitted into the four pressure contact cutting edges, the satisfactory contact with the core wire portion of the thick electric wire can be obtained at the wide pressure contact cutting edges on both side of the axial direction. Moreover, since the pair of the side plates spread outward, even in the case of the thick electric wire, its core wire portion is not whittled by the two narrow pressure contact cutting edges, and thus the satisfactory contact can be obtained. Therefore, even in the case of a thick electric wire, the satisfactory contact can be obtained at the plural pressure contact cutting edges, and the holding force does not weaken.

BRIEF DESCRIPTION OF THE ACCOMPANYING DRAWINGS

The above and further objects and novel feature of the present invention will more fully appear from the following detailed description when the same is read in conjunction with the accompanying drawings, in which.

DETAILED DESCRIPTION OF THE PREFERRED EMBODIMENTS

Figure 1:
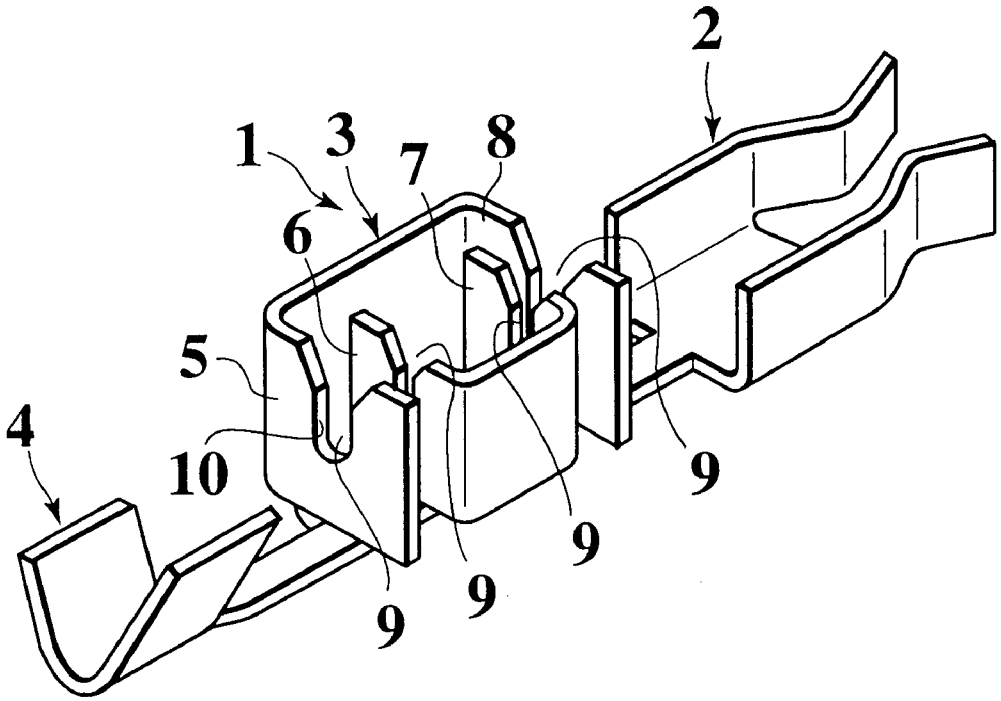
FIG.1 PRIOR ART
FIG. 1 is a perspective view showing a conventional pressure contact terminal.

There will be detailed below the preferred embodiments of the present invention with reference to the accompanying drawings. Like members are designated by like reference characters.

Figure 2A:
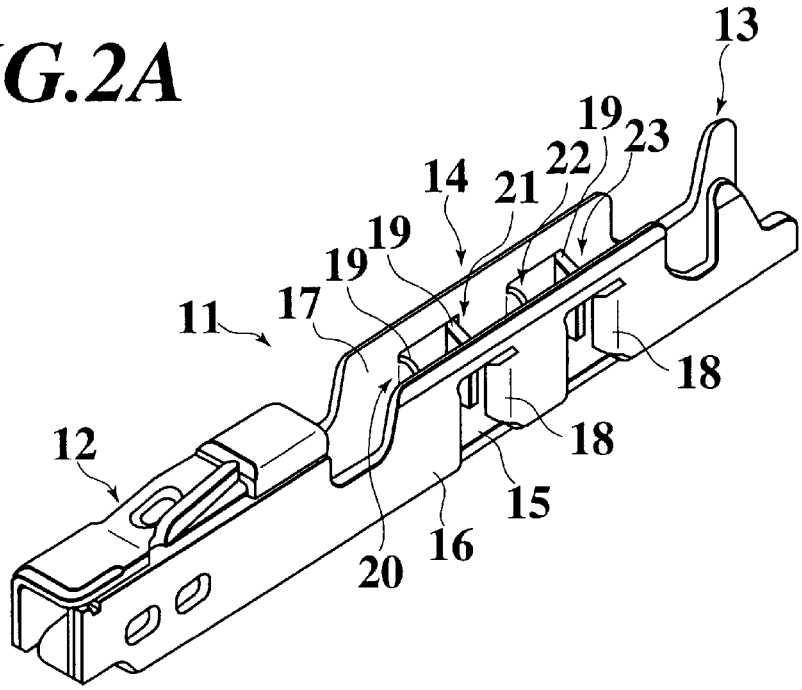
FIG. 2A is a perspective view showing a pressure contact terminal of the present invention.
Figure 2B:
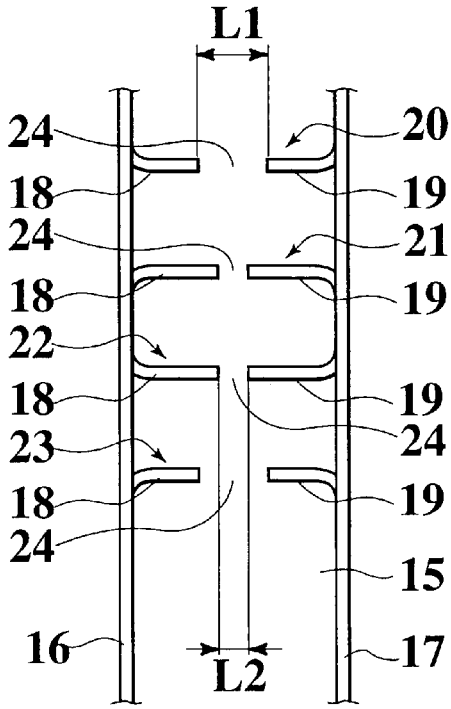
FIG. 2B is a plan view showing a pressure contact section.

FIG. 2A is a perspective view showing whole of the pressure contact terminal, and FIG. 2B is a plan view showing an enlarged pressure contact section of FIG. 2A.

As shown in FIG. 2A, a pressure contact terminal 11 of the present embodiment is formed by blanking an uniform electrically conductive plate material in an expanded state and successively bending it. A contact section 12 which comes in contact with a mated terminal is provided its one side, and an electric wire holding section 13 for holding a terminal portion of a covered electric wire (not shown) is provided on the other side. A pressure contact section 14 where the terminal portion of the covered electric wire is brought into pressure-contact with and connected with is provided between the contact section 12 and the electric wire holding section 13.

At the pressure contact section 14, a pair of side plates 16 and 17 rise from both sides of a bottom plate 15 to the same direction, and four pairs of pressure contact plates 18 and 19 are projected from the pair of the side plates 16 and 17 with them facing each other so that four pressure contact cutting edges 20, 21, 22 and 23 are formed. Points of the pressure contact plates 18 and 19 are cutting edge sections, and spaces between the cutting edges are press-fitting slots 24. When the covered electric wire is press-fitted into the press-fitting slots 24, the covered portion of the covered electric wire is cut by the cutting edge sections, and when the cutting edge sections come in contact with the core wire portion, the pressure contact cutting edges 20, 21, 22 and 23 are electrically connected with the covered electric wire.

In addition, as for the four pressure contact cutting edges 20, 21, 22 and 23, the two wide pressure contact cutting edges 20 and 23 where the width L1 of the press-fitting slots 24 is wide are arranged on both sides along the axial direction of the covered electric wire, and the two narrow pressure contact cutting edges 21 and 22 where the width L2 of the press-fitting slots 24 is narrow are arranged between the wide pressure contact cutting edges 20 and 23. The width L1 of the press-fitting slots 24 of the wide pressure contact cutting edges 20 and 23 is set so that a thick electric wire (see FIG. 3A) 25 is brought into pressure-contact therewith satisfactorily, and the width L2 of the press-fitting slots 24 of the narrow pressure contact cutting edges 21 and 22 is set so that a thin electric wire (see FIG. 3B) 26 is brought into pressure-contact therewith satisfactorily.

Figure 3B:
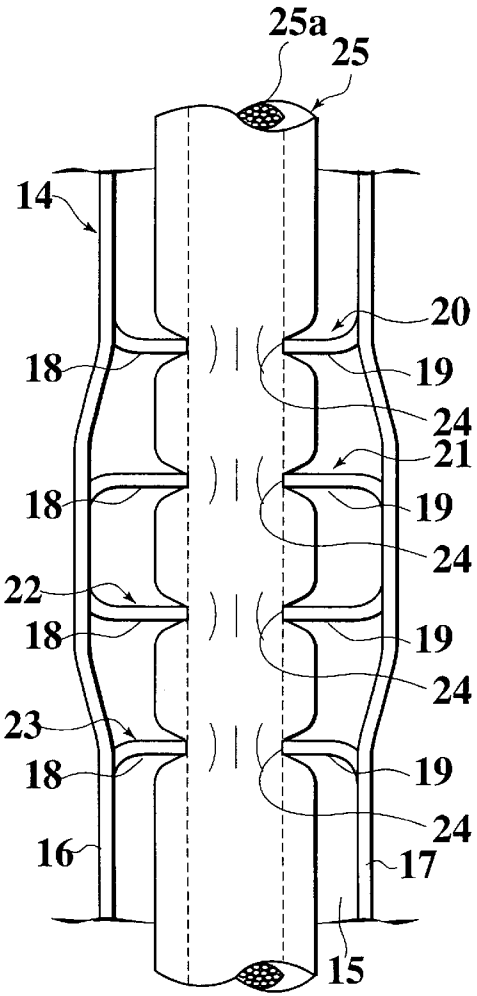
FIG. 3B is a plan view showing a state that a thick electric wire is press-fitted into the pressure contact section.
Figure 3A:
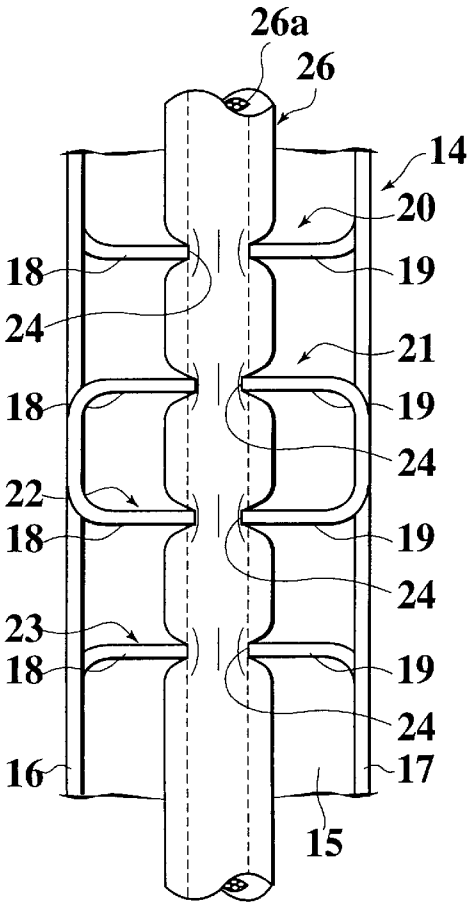
FIG. 3A is a plan view showing a state that a thin electric wire is press-fitted into the pressure contact section.

The following will describe a method of press-fitting the thick electric wire 25 shown in FIG. 3A and a method of press-fitting the thin electric wire 26 shown in FIG. 3B.

As shown in FIG. 3A, when the thin covered electric wire 26 is press-fitted into the press-fitting slots 24 of the pressure contact cutting edges 20, 21, 22 and 23, the wide pressure contact cutting edges 20 and 23 and the narrow pressure contact cutting edges 21 and 22 cut the covered portion of the thin covered electric wire 26, and the pressure contact cutting edges 20, 21, 22 and 23 electrically come in contact with a core wire portion 26*a* of the covered electric wire 26.

In addition, as shown in FIG. 3B, when the thick electric wire 25 is press-fitted into the press-fitting slots 24 of the pressure contact cutting edges 20, 21, 22 and 23 in the pressure contact section 14, satisfactory contact with the thick electric wire 25 can be obtained at the wide pressure contact cutting edges 20 and 23. When the thick electric wire 25 is press-fitted into the press-fitting slots 24, the pair of the side plates 16 and 17 spread outward. Accordingly, the narrow pressure contact cutting edges 21 and 22 do not cut into the core wire portion 25*a*, and they cut the covered portion without whittling the core wire portion 25*a*. As a result, the satisfactory contact is obtained, and the pressure contact cutting edges 20, 21, 22 and 23 cut into the covered portion substantially uniformly. For this reason, the holding force of the covered electric wire In the axial direction does not weaken.

According to the pressure contact terminal 11 of the present embodiment, when the thick covered electric wire 25 is press-fitted into the plural pressure contact cutting edges 20, 21, 22 and 23, the satisfactory contact with the core wire portion 25*a* of the thick electric wire 25 can be obtained at the wide pressure contact cutting edges 20 and 23. Moreover, since the pair of the side plates 16 and 17 spread outward, even in the case of the thick electric wire 25, the core wire portion 25*a* is not whittled by the narrow pressure contact cutting edges 21 and 22, and thus the satisfactory contact can be obtained. Therefore, even in the case of the thick electric wire, the satisfactory contact can be obtained at the plural pressure contact cutting edges, and the holding force does not weaken. Moreover, in the case of the thin covered electric wire 26, the satisfactory contact can be obtained by the wide pressure contact cutting edges 20 and 23 and the narrow pressure contact cutting edges 21 and 22.

Therefore, the core wire portion 25*a* of the thick electric wire 25 can be prevented from whittling, and the satisfactory contact can be obtained at all the pressure contact cutting edges 20, 21, 22 and 23, and electric wires with different sizes can be commonly brought into pressure-contact.

Here, the present embodiment referred to the example that two narrow pressure contact cutting edges 21 and 22 are used, but one or three and more narrow pressure contact cutting edges may be used.

While preferred embodiments of the present invention have been described using specific terms, such description is for illustrative purposes, and it is to be understood that changes and variations may be made without departing from the spirit or scope of the following claims.

What is claimed is:

1. A pressure contact terminal, comprising:

a bottom plate;

a pair of side plates rising from both sides of the bottom plate in same direction; and a plurality of pressure contact cutting edges, the pressure contact cutting edges formed in a manner such that a pair of pressure contact plates are projected from the pair of the side plates so as to face each other, the pressure contact cutting edges formed with a plurality of pressure contact slots into which a covered electric wire is press-fitted so that the covered electric wire is press-fitted between the pressure contact plates;

wherein the plurality of pressure contact cutting edges contains at least two wide pressure contact cutting edges having the pressure contact slots with wide width and a narrow pressure contact cutting edge having the pressure contact slot with narrower width than that of the pressure contact slots of the wide pressure contact cutting edges;

wherein the wide pressure contact cutting edges are arranged along an axial direction of the covered electric wire; and wherein the narrow pressure contact cutting edge is arranged between the wide pressure contact cutting edges.

2. A pressure contact terminal according to claim 1, wherein at least two narrow pressure contact cutting edges are arranged between the wide pressure contact cutting edges.

* * * * *

UNITED STATES PATENT AND TRADEMARK OFFICE

CERTIFICATE OF CORRECTION

PATENT NO. : 6,206,721 B1
DATED : March 27, 2001
INVENTOR(S) : Junko Ishida

It is certified that error appears in the above-identified patent and that said Letters Patent is hereby corrected as shown below:

Column 4, claim 1,
Line 55, after "terminal", delete ",".
Line 59, "in same" should read -- in a same --.
Line 60-61, delete "the pressure contact cutting edges". and insert -- at ends of pressure contact plates and --.
Line 61, delete "in a manner".
Line 63, delete "so as to" and insert -- such that the plurality of pressure contact cutting edges --.

Signed and Sealed this

Sixteenth Day of April, 2002

*Attest:*

*Attesting Officer*

JAMES E. ROGAN
*Director of the United States Patent and Trademark Office*